United States Patent [19]

Schleppinghoff et al.

[11] 4,431,528

[45] Feb. 14, 1984

[54] PROCESS FOR THE HYDROGENATION OF HYDROCARBONS

[75] Inventors: Bernhard Schleppinghoff, Dormagen; Horst Reinhardt, Bergheim; Herbert Tschorn, Dormagen, all of Fed. Rep. of Germany

[73] Assignee: EC Erdolchemie GmbH, Cologne, Fed. Rep. of Germany

[21] Appl. No.: 392,035

[22] Filed: Jun. 25, 1982

[30] Foreign Application Priority Data

Jul. 14, 1981 [DE] Fed. Rep. of Germany ..... 3127751

[51] Int. Cl.[3] ..... C10G 45/00; C10G 25/02

[52] U.S. Cl. ..... 208/255; 208/88; 208/91; 208/143; 585/865

[58] Field of Search ..... 208/91, 88, 255, 143; 585/865

[56] References Cited

U.S. PATENT DOCUMENTS

| | | | |
|---|---|---|---|
| 2,566,353 | 9/1951 | Mills | 208/91 |
| 2,780,582 | 2/1957 | Junk, Jr. et al. | 208/88 |
| 3,019,199 | 1/1962 | Chanmugam | 260/2.2 |
| 3,668,271 | 6/1972 | Haag et al. | 260/683.9 |
| 3,953,323 | 4/1976 | Nolan, Jr. et al. | 205/255 |
| 4,031,157 | 6/1977 | Rescalli et al. | 585/865 |
| 4,066,713 | 1/1978 | Favaci et al. | 585/865 |
| 4,208,271 | 6/1980 | Cosyns et al. | 208/255 |

FOREIGN PATENT DOCUMENTS

| | | |
|---|---|---|
| 1055233 | 1/1967 | United Kingdom . |

*Primary Examiner*—Delbert E. Gantz
*Assistant Examiner*—Cynthia A. Prezlock
*Attorney, Agent, or Firm*—Sprung, Horn, Kramer & Woods

[57] ABSTRACT

Unsaturated hydrocarbons and mixtures in which the latter are present are treated with anion exchangers prior to hydrogenation and are then hydrogenated catalytically in a known manner. The treatment with anion exchangers is carried out at 0°-120° C. and at a space velocity of 0.1 to 10 l of hydrocarbons to be hydrogenated per l of exchanger, per hour. The process avoids other, energy-intensive pretreatments, for example distillation of the hydrocarbons to be hydrogenated, or washing, and can be carried out in simple equipment. A considerable prolongation of the catalyst operating time is achieved in the subsequent catalytic hydrogenation.

20 Claims, No Drawings

PROCESS FOR THE HYDROGENATION OF HYDROCARBONS

BACKGROUND OF THE INVENTION

The invention relates to a process for the hydrogenation of unsaturated hydrocarbons, in which these unsaturated hydrocarbons are treated with anion exchangers prior to a catalytic hydrogenation which is in itself known.

When olefinic or diolefinic hydrocarbon fractions or hydrocarbon fractions containing acetylenes are hydrogenated, the deposition of impurities or the formation of polymers on the catalyst causes a progressive poisoning and deactivation of this catalyst, which results in a relatively short catalyst life. This applies particularly to the selective hydrogenation of diolefinic cracked gasoline fractions which are produced, for example, when ethylene is obtained by cracking naphtha, gas oils and the like.

Various processes are known for the selective hydrogenation of these cracked gasoline fractions and for their pretreatment before being employed in this partial hydrogenation (Asinger, Die Petrolchemische Industrie (The Petrochemical Industry), Akademie-Verlag Berlin, page 618 et seq.). These include pretreatments by heat, the removal of polymers by distillation, the removal of polymers from the hydrogenation catalyst by washing, employing trickle phases or liquid phase hydrogenation reactions in which partially hydrogenated hydrocarbon streams are recycled, and the general improvement of the hydrogenation catalyst. In these processes, catalyst lives of a few months up to a year, and only occasionally longer, are achieved. However, a relatively high outlay is required in the pretreatment for these processes, for example a high outlay of energy if polymers are removed by distillation and a high outlay of investment is hydrogenated product streams are recycled.

The hydrogenation of acetylene-containing or olefinic hydrocarbons also leads, as a result of the formation of polymers and as a result of the presence of impurities, to the catalyst surface becoming coated or the catalyst becoming poisoned and thus to an unsatisfactory catalyst life. Thus, for example, when dimers and oligomers from the oligomerization of $C_3$ and $C_4$ olefines are hydrogenated, catalyst lives of only a few months are achieved.

Our own attempts to employ intimate mixing of the hydrocarbon fractions to be hydrogenated with an aqueous solution having an alkaline reaction, as a pretreatment before the actual hydrogenation, have not led to any appreciable improvement in catalyst life.

SUMMARY OF THE INVENTION

It is, therefore, entirely surprising that a considerable increase in catalyst life is obtained by subjecting the unsaturated hydrocarbons which are intended to be hydrogenated, to a treatment with an anion exchanger.

Accordingly, a process for the hydrogenation of hydrocarbons has been found, which is characterized in that unsaturated hydrocarbons are treated with anion exchangers at 0° to 120° C. and are then hydrogenated catalytically in a known manner.

DETAILED DESCRIPTION OF THE INVENTION

The anion exchangers to be employed in accordance with the invention can be natural or synthetic, inorganic or organic anion exchangers. The following may be mentioned as examples of natural or artificial inorganic anion exchangers: natural or artificial scapolites or hydroxyl-apatites, iron oxide gel, coal anion exchangers, such as ammoniated grades of coal, clay minerals, insoluble salts, such as phosphates, hydrated zirconium oxides, aluminum oxide and others.

Examples of organic anion exchangers which may be mentioned are styrene/divinylbenzene resins in gel or macroporous form, resins formed by condensation from phenols and formaldehyde, cellulose anion exchangers containing the functional group $—OC_2H_4N(C_2H_5)_2$ or $—OCH_2C_6H_4NH_2$ or another strongly basic functional group, (meth)-acrylic resins or epichlorohydrin/polyamine condensation products.

All these resins have been crosslinked and thus rendered insoluble. Instead of the known crosslinking agent divinylbenzene, it is also possible to employ, for example, trivinylbenzene or trivinylcyclohexane. In general, the crosslinking agent is present in a quantity of about 0.3 to 80% by weight, preferably 1 to 65% by weight and particularly preferentially 2 to 50% by weight, relative to the total quantity of comonomers. Anion exchangers having one of the said matrices contain, as functional groups, for example, quaternary ammonium groups $—NR_3^+$, such as $—N(CH_3)_3^+$ or $—N(CH_3)_2CH_2CH_2OH^+$, or tertiary amino groups $—NR_2$, such as $—N(CH_3)_2$. The matrices can also carry alkyleneamine or imino groups or unsubstituted amino groups. Anion exchangers of the types described have, for example, total capacities for ion exchange of about 0.5 to 6 equivalents/l of resin. Anion exchangers of this type which have been described and the processes for obtaining or preparing them have been known for a long time (Houben-Weyl, Methoden der organischen Chemie (Methods of Organic Chemistry), Volume 1, page 526; F. Helfferich, Ion Exchange, McGraw-Hill Book Company, New York 1962).

Anion exchangers, in particular synthetic organic anion exchangers, are available as commercial products from many manufacturers in a great variety of modifications and in a large number of grades. Such anion exchangers can be employed on their own or as a mixture of several anion exchangers. In accordance with the invention, it is preferable to employ synthetic organic anion exchangers. It is particularly preferable to employ anion exchangers which have a matrix composed of styrene/divinylbenzene and a gel or macroporous structure.

The said anion exchangers can be loaded with various ions, for example hydroxyl, chloride, bromide, sulphate, acetate or formate ions. It is also possible to employ mixtures of different ion exchangers which are loaded with a variety of the anions mentioned as examples. It is also possible to employ mixtures of the same anion exchanger in which the resin particles present in the mixture are charged with a variety of the anions mentioned as examples. Finally, it is also possible to employ anion exchangers containing different anions in a particle of resin, as a result of being partially loaded with salts of the different anions which have been mentioned as examples. It is preferable to employ anion exchangers or mixtures of anion exchangers in which hydroxyl ions, if appropriate together with one or more other anion(s), are present, wholly or partially, as the anion on different particles of resin or on the same particle of resin. A proportion of at least 10%, preferably at least 50% and particularly preferentially 100%, of hydroxyl ions, relative to the total number of anions, may be mentioned as an example of this.

Olefinic, diolefinic or acetylenic hydrocarbons, or hydrocarbons containing one or more acetylenic bonds as well as one or more olefinic bonds, may be mentioned as examples of unsaturated hydrocarbons which are treated in accordance with the invention. Such unsaturated bonds can be either terminal or non-terminal. Furthermore, such hydrocarbons can be employed as a single-substance cut, as a mixture with one another or as a mixture with other substances. Examples of such other substances can be saturated hydrocarbons, hydrogen, carbon monoxide, carbon dioxide, nitrogen or noble gases. Both branched and straight-chain unsaturated or saturated hydrocarbons can be treated in accordance with the invention. Their chain length is not critical for carrying out the process according to the invention. The chain length of 2 to 30, preferably 2 to 24, carbon atoms may be mentioned as an example. Examples of such hydrocarbons and hydrocarbon mixtures which have been mentioned are fractions such as are formed when various cracking feedstocks are cracked, or are prepared from the latter, and also fractions such as are produced when cracked gasoline and cracked gasoline fractions are selectively hydrogenated, and also fractions such as are produced when $C_3$ and $C_4$ olefins or olefin fractions are oligomerized with the aid of acid catalysts. It is preferable to carry out the process according to the invention by employing cracked fractions, and oligomerization products having unsaturated bonds, which, if desired, also contain paraffins, naphthenes and/or aromatic hydrocarbons as constituents of the mixture.

The process according to the invention is carried out at a temperature of, for example, 0° to 120° C., preferably 10° to 50° C. and particularly preferentially 20° to 30° C., and under a pressure of 1 to 100 bars, preferably 1 to 15 bars and particularly preferentially 1 to 5 bars. When the process according to the invention is carried out, the hydrocarbons to be treated are at least partially in the liquid phase, for example to the extent of at least 30%, preferably at least 80% and particularly preferentially completely in the liquid phase, relative to the total quantity of the hydrocarbons or of the constituents of the mixture.

The process according to the invention can be carried out by passing the hydrocarbons downwards or upwards through a bed of the anion exchanger particles. In this process, the anion exchanger particles can be contained in a fixed bed, a suspended bed or a fluidized bed. The equipment to be used for carrying out the process according to the invention can be very simple, such as, for example, a cylindrical reactor without internal fitments. It is also possible, of course, to use the anion exchangers in different beds which are arranged, for example, on different trays of a cylindrical reactor. It is also possible to arrange distributor trays between each of two such beds in order to ensure that the various beds of the anion exchangers are uniformly wetted.

The process according to the invention can be used in the same manner and with the same advantage for unsaturated hydrocarbons or the abovementioned mixtures which are intended subsequently to be subjected to a selective hydrogenation or to complete hydrogenation.

The anion exchanger bed is fed with the unsaturated hydrocarbon to be treated, or one of the said mixtures, at an LHSV (Liquid Hourly Space Velocity) of 0.1–10, preferably 0.5–5 and particularly preferentially 1–2 l, of hydrocarbons per l of exchanger per hour.

After the treatment with an anion exchanger, the unsaturated hydrocarbons or the mixtures mentioned above are subjected, in a known manner, to a selective catalytic hydrogenation or to complete catalytic hydrogenation. The conditions for such a hydrogenation are known to those skilled in the art. For example, 1 to 10 mols of hydrogen are employed per mol of the double or triple bond to be hydrogenated. The process is carried out, for example, at 10° to 350° C. and 1 to 200 bars. Examples of hydrogenation catalysts which may be mentioned are noble metal catalysts, such as palladium or platinum, Raney catalysts, such as Raney nickel, Raney cobalt, Raney iron or mixtures of such Raney catalysts, if desired with the addition of promoters, or sulphide hydrogenation catalysts, such as cobalt sulphides, nickel sulphides, molybdenum sulphides or mixtures thereof. Such hydrogenation catalysts can be employed in a known manner as such or in conjunction with an inert support. Suitable supports are $SiO_2$, $Al_2O_3$, dead-burned MgO, carbonates, such as $CaCO_3$ or $BaCO_3$, sulphates, such as $BaSO_4$, or active charcoal. A catalytic hydrogenation of this type can be carried out, for example, in the gas phase, in a trickling phase or in the liquid phase, with a fixed or suspended catalyst.

If the process according to the invention is used, one can omit all the processes hitherto known for pretreating the material to be hydrogenated, with the aim of increasing the catalyst life. Compared with the pretreatment processes hitherto known, a marked increase in catalyst life is achieved in accordance with the invention. Thus, for example, when selectively hydrogenating pyrolysis gasoline using the process according to the invention, the catalyst life is at least doubled. Similarly, the treatment of oligomers from $C_3$ and $C_4$ oligomerization reactions before the oligomers are completely hydrogenated leads to a considerable increase, for example a 2-fold to 5-fold increase, in the catalyst life.

Compared with pretreatment processes hitherto known, the process according to the invention is more advantageous in terms of energy and thus in terms of cost. An example which may be mentioned in support of this is the omission of the distillation of the material to be hydrogenated, which is energy-intensive and thus expensive.

The process according to the invention can be carried out in simple and cheap apparatus and thus, in contrast with many pretreatment processes hitherto customary, only requires a low capital investment.

Finally, as a result of the prolonged catalyst life, many of the plant shut-downs hitherto necessary are not required.

EXAMPLES

The treatment according to the invention is illustrated in connection with the hydrogenation reactions described below.

(a) Examples of the Selective Hydrogenation of Cracked Gasoline Fractions

The hydrogenation equipment consisted of: a reciprocating feed pump, a preheater, a hydrogenation reactor, a condenser and a separator. The hydrogenation reactors employed were VA-steel reactors of an internal diameter of 15 mm and length 700 mm, heated electrically or by means of a jacket. The lower half (about 340 mm in length, corresponding to 60 ml of catalyst) of the reactor was filled with a Pd-on-$Al_2O_3$ catalyst. The reactor space above this was filled with $Al_2O_3$ spheres and served as an additional preheater.

The hydrogenation was carried out in the trickle phase using a grade of hydrogen produced in cracking plants and containing approx. 15% of $CH_4$, at 26 bars and at an LHSV (Liquid Hourly Space Velocity) of 5. The bromine number (g of $Br_2$/100 g) of the hydrogenated product was used as a criterion of the efficiency of hydrogenation. The feedstock was pyrolysis gasoline which it was desired to hydrogenate selectively to a diene number of not more than 1. On the basis of comparative measurements, this corresponds to reducing the bromine number to 40–45 g of $Br_2$/100 g. In determining catalyst life, the inlet temperature of 30°–60° C. was increased, depending on the hydrogenation activity, to 110°–160° C., in which connection the catalyst can be regarded as deactivated when the temperature exceeds approx. 100° C.

EXAMPLE 1

(For Comparison)

Non-pretreated pyrolysis gasoline was employed, as described above, for the selective hydrogenation of the diolefines. The catalyst contained 5 g of Pd/l on $Al_2O_3$, impregnated only on the surface. Fresh hydrogen was admitted to the reactor at the rate at which exit gas was withdrawn. The exit gas rate was 200 l/hour. The hydrogenation was carried out at an inlet temperature of 60° C. After an operating period of 5 days, the bromine number rose to more than 50 g of $Br_2$/100 g, after which it was necessary to increase the inlet temperature several times by 10°–15° C. After an operating period of 6 weeks, the inlet temperature had exceeded 110° C. During the whole operating period, almost without exception, it was only possible to achieve bromine numbers of 50 g of $Br_2$/100 g.

The bromine numbers and inlet temperatures throughout the operating period are listed in Table I:

EXAMPLE 2

(For Comparison)

As Example 1, a noble metal catalyst, 5 g of Pd/l on $Al_2O_3$, but completely impregnated. As in Example 1, after an operating period of one week the inlet temperature had to be increased several times by 10°–15° C. After an operating period of approx. 4 weeks, the inlet temperature had exceeded 110° C.

The bromine numbers and inlet temperatures throughout the operating period are listed in Table II:

EXAMPLE 3

(For Comparison)

As Example 1, but distilled pyrolysis gasoline was used in the hydrogenation. The inlet temperature was initially 60° C., but the exit gas rate, and thus the fresh hydrogen rate, had to be cut back to 30 l/hour because of the high initial activity. It did not reach the "normal rate" of 200 l/hour characteristic of the apparatus until after approx. 6 weeks. Here too, analogously to Examples 1 and 2, the inlet temperature had to be increased in stages by 10°–15° C., but the intervals of time were considerably longer. The test was discontinued after 15 weeks at an inlet temperature of 100° C. and a bromine number of 47 g of $Br_2$/100 g.

The bromine numbers and inlet temperatures throughout the operating period are listed in Table III:

TABLE I (relating to Example 1)

| Operating time (weeks) | Inlet temperature (°C.) | Bromine number before the particular increase in temperature (g of $Br_2$/100 g) |
|---|---|---|
| 1 | 60 | 55 |
| 2 | 70 | approx. 50 |
| 3 | 80–90 | 58 |
| 4 | 90–100 | 52 |
| 5 | 100 | 58 |
| 6 | 110 | 52 |

TABLE II (relating to Example 2)

| Operating time (weeks) | Inlet temperature (°C.) | Bromine number before the particular increase in temperature (g of $Br_2$/100 g) |
|---|---|---|
| 1 | 60 | 48 |
| 2 | 90 | 46–48 |
| 3 | 90–100 | 48 |
| 4 | over 110 | 48 |

TABLE III (relating to Example 3)

| Operating time (weeks) | Inlet temperature (°C.) | Bromine number before the particular increase in temperature (g of $Br_2$/100 g) |
|---|---|---|
| 2 | 60 | 44 |
| 4 | 65 | 47 |
| 6 | 70 | 44 |
| 8 | 70–80 | 50 |
| 10 | 80 | 48 |
| 12 | 90 | 46 |
| 14 | 100 | 44 |
| 15 | 100 | 47 |

EXAMPLE 4

(In Accordance With The Invention)

As Example 3, but the pyrolysis gasoline employed had not been distilled but had been pretreated with an anion exchanger beforehand. This pretreatment with anion exchanger is carried out in a fixed bed reactor at 20° C. under virtually atmospheric pressure, using an ion exchanger mixture consisting of one part of a weakly basic, macroporous ion exchanger based on polystyrene in the OH form (Bayer Lewatit MP 62) and of one part of a strongly basic ion exchanger, in the gel form, based on polystyrene, in the Cl' form (Bayer Lewatit M 500). The pretreatment reactor consisted of a glass tube of length 350 mm and width 35 mm and was completely filled with the anion exchanger mixture.

Because of the high initial activity, it was necessary to reduce the exit gas rate to approx. 40 l/hour and the inlet temperature to 30° C. After approx. 4 weeks, the inlet temperature was increased to 40° C. After an operating period of 20 weeks, the exit gas rate was still 120 l/hour instead of the "normal rate" of 200 l/hour, characteristic of the apparatus. After an operating period of 20 weeks, the inlet temperature was still 40° C., while the bromine numbers varied between 38 and 45 g of $Br_2$/100 g, but, as a rule, were approx. 40 g of $Br_2$/100 ml.

(b) Examples of the Complete Hydrogenation of Olefinic Oligomer Fractions

The hydrogenation equipment consisted of: a reciprocating feed pump, a preheater, a hydrogenation reactor, a condenser and a separator. The hydrogenation reactors employed were VA-steel reactors, of internal diameter 25 mm and length 700 mm, equipped with a jacket. The reactors were charged with 400 ml of catalyst. The free space above this was filled with $Al_2O_3$ spheres. These served both to distribute the liquid and as an additional preheating zone.

The hydrogenation was carried out in the trickle phase using a trimer obtained from a $C_4$ oligomerization reaction (isododecene) as the feedstock and a grade of hydrogen produced in cracking plants and containing approx. 15% of methane, at 26 bars and an LHSV of 1.5. The feedstock was preheated to 180° C. and hydrogenated at a reactor temperature of 220° C. The bromine number (g of $Br_2$/100 g) of the hydrogenated product served as a criterion of the efficiency of hydrogenation. A bromine number of 0.1 $Br_2$/100 g was taken as the limiting value of the product specification and the catalyst was regarded as deactivated when this limiting value was exceeded.

EXAMPLE 5

(For Comparison)

Non-pretreated isododecene was introduced into the hydrogenation apparatus, as described above, in order to hydrogenate the olefins completely. The catalyst contained 18 g of Pd/l on $Al_2O_3$, impregnated only on the surface. Fresh hydrogen was introduced into the reactor at the same rate at which exit gas was withdrawn. The exit gas rate was 200 l/hour.

The progress of the bromine number throughout the operating period of the catalyst is shown in the following table:

| Operating time (weeks) | Bromine number (g of $Br_2$/100 g) |
|---|---|
| 1 | <0.01 |
| 2 | <0.01 |
| 3 | <0.01 |
| 4 | 0.01 |
| 5 | 0.02 |
| 6 | 0.05 |
| 7 | 0.08 rapidly increasing to 0.28 |

EXAMPLE 6

(In Accordance with the Invention)

As Example 5, but the isododecene feedstock was treated with an anion exchanger before entering the hydrogenation reaction. This anionic preliminary purification was carried out in a fixed bed reactor at 20° C., virtually under atmospheric pressure, using a mixture of anion exchangers consisting of one part of a weakly basic, macroporous ion exchanger based on polystyrene, in the OH form (Bayer Lewatit MP 62) and of one part of a strongly basic ion exchanger, in the gel form, based on polystyrene, in the Cl' form (Bayer Lewatit M500).

The reactor consisted of a glass tube of length 350 mm and width 35 mm and was completely filled with the anion exchanger mixture.

| Operating time (weeks) | Bromine number (g of $Br_2$/100 g) |
|---|---|
| 1 | <0.01 |
| 3 | <0.01 |
| 5 | <0.01 |
| 7 | <0.01 |
| 9 | <0.01 |
| 11 | <0.01 |
| 13 | <0.01 |
| 15 | <0.01 |
| 17 | 0.02 |
| 19 | 0.08 |
| 20 | >0.10 |

Compared with Example 5, a considerable prolongation of the catalyst operating time has been achieved by treating the feedstock with anion exchangers.

What is claimed is:

1. In a process for the hydrogenation of an unsaturated hydrocarbon by contacting the same with hydrogen in the presence of a catalyst, the improvement wherein prior to said contacting with hydrogen the unsaturated hydrocarbon is contacted at 0° to 120° C. with an anion exchanger whereby to prolong the life of the catalyst.

2. A process according to claim 1, wherein the anion exchanger is one having a matrix composed of styrene/divinylbenzene and a gel or macroporous structure.

3. A process according to claim 1, wherein the contact with anion exchanger is carried out at 10° to 50° C.

4. A process according to claim 1, wherein the contact with anion exchanger is carried out at 20° to 30° C.

5. A process according to claim 1, wherein the unsaturated hydrocarbons are contained in a hydrocarbon stream obtained from a cracking process.

6. A process according to claim 1, wherein the unsaturated hydrocarbons are present in a stream resulting from catalytic oligomerization of $C_3$ and/or $C_4$ olefins.

7. A process according to claim 1, wherein the anion exchanger is an inorganic anion exchanger.

8. A process according to claim 1, wherein the anion exchanger is an organic anion exchanger.

9. A process according to claim 1, wherein the anion exchanger is an organic anion exchanger and the organic anion exchanger is styrene/divinylbenzene resin in gel or macroporous form, a resin formed by condensation of a phenol with formaldehyde, a cellulose anion exchanger containing the functional group $—OC_2H_4N(C_2H_5)_2$ or $—OCH_2—C_6H_4NH_2$ or another strongly basic functional group, a (meth)-acrylic resin or an epichlorohydrin/polyamine condensation product, or an organic anion exchanger which contains a quaternary ammonium functional group or a tertiary amino group or is one which has been loaded with hydroxyl, chloride, bromide, sulphate, acetates, or formate ions.

10. A process according to claim 1, wherein the contacting with anion exchanger is conducted at 1 to 100 bars.

11. A process according to claim 1, wherein the contacting with anion exchanger is conducted at 1 to 15 bars.

12. A process according to claim 1, wherein the contacting with anion exchanger is conducted at 1 to 5 bars.

13. A process according to claim 1, wherein the contact with anion exchanger is conducted at a liquid hourly space velocity of 0.1 to 10 liters hydrocarbon per liters exchanger per hour.

14. A process according to claim 1, wherein the contact with anion exchanger is conducted at a liquid hourly space velocity of 0.5 to 5 liters hydrocarbon per liters exchanger per hour.

15. A process according to claim 1, wherein the contact with anion exchanger is conducted at a liquid hourly space velocity of 1 to 2 liters hydrocarbon per liters exchanger per hour.

16. A process according to claim 1, wherein the exchangers are crosslinked.

17. A process according to claim 1, wherein said anion exchangers comprise hydroxyl ions.

18. A process according to claim 17, wherein the hydroxyl ions comprise at least 10% of the total number of anions.

19. A process according to claim 17, wherein the hydroxyl ions comprise at least 50% of the total number of anions.

20. A process according to claim 1, wherein at least 30 weight% of the hydrocarbon is in the liquid phase.

* * * * *